United States Patent [19]

Bonecutter et al.

[11] 4,059,816

[45] Nov. 22, 1977

[54] ELECTRICAL LOADBREAK FUSE AND CANISTER ASSEMBLY

[75] Inventors: Thayer A. Bonecutter; Charles E. Lewis, both of Zanesville, Ohio; John E. Smith, Nacogdoches, Tex.

[73] Assignee: McGraw-Edison Company, Elgin, Ill.

[21] Appl. No.: 707,709

[22] Filed: July 21, 1976

Related U.S. Application Data

[63] Continuation of Ser. No. 633,692, Nov. 20, 1975, abandoned, which is a continuation of Ser. No. 545,782, Jan. 31, 1975, abandoned.

[51] Int. Cl.[2] ..... H01H 85/38

[52] U.S. Cl. ..... 337/278; 200/144 R; 337/273; 363/41

[58] Field of Search ..... 337/278, 282, 280, 273, 337/180, 181, 194, 202, 207; 200/144 R, 144 C

[56] References Cited

U.S. PATENT DOCUMENTS

| | | | |
|---|---|---|---|
| 2,777,917 | 1/1957 | Whitfield | 337/278 |
| 3,628,092 | 12/1971 | Keto | 317/15 |
| 3,732,517 | 5/1973 | Keto et al. | 337/278 |
| 3,792,215 | 2/1974 | Keto | 200/144 C |

*Primary Examiner*—Harold Broome

*Attorney, Agent, or Firm*—Jon Carl Gealow; Thomas E. McDonald; Ronald J. LaPorte

[57] ABSTRACT

An electrical loadbreak fuse and canister assembly with arc quenching means operative upon withdrawal of the fuse from the canister or upon insertion of the fuse in the canister under either load or fault conditions. The canister, formed of a glass filled polyester tube, is designed to extend within the enclosure for an electrical device to be protected by the assembly, and is provided with a flange at the outer end for mounting on the enclosure. A fixed loadbreak contact at the inner end of the canister is enclosed within a non-conductive sleeve having a collar formed there around. The inner end of the fuse is provided with a loadbreak contact probe having a non-conductive tip and with a non-conductive disc mounted between the fuse and the contact probe. Both the sleeve and collar, and the disc serve to defuse and cool ionized gases generated by arcing between the loadbreak contacts within the canister.

12 Claims, 6 Drawing Figures

ELECTRICAL LOADBREAK FUSE AND CANISTER ASSEMBLY

This is a continuation of application Ser. No. 633,692 filed Nov. 20, 1975, which is a continuation of application Ser. No. 545,782 filed Jan. 31, 1975, both abandoned.

BACKGROUND OF THE INVENTION

I. Field of the Invention

This invention relates to the combination of a current-limiting fuse and a loadbreak device for protecting an electrical apparatus such as a distribution transformer.

II. Description of the Prior Art

In the past various arrangements have been provided for utilizing protective fuses with transformers in order to protect the transformer from destruction by large fault currents. At one point in time the protective arrangement included a protective fuse link and a separate loadbreaking switch connected in series with a transformer winding. As the capacities of electrical distribution systems were increased, to deliver higher levels of power, increased power became available at a fault, and current-limiting fuses were provided for interrupting these large fault current. More recently the current limiting and loadbreaking functions have been combined in a single assembly such as disclosed in U.S. Pat. No. 3,628,092, issued Dec. 14, 1971. Further improvements on the Electrical Inductive Apparatus with Removable Protective Fuse, disclosed in U.S. Pat. No. 3,628,092, are claimed to be shown in U.S. Pat. No. 3,732,517 issued May 8, 1973 and in U.S. Pat. No. 3,792,215 issued Feb. 12, 1974. Both of the latter mentioned patents are directed toward improving the performance of the device with respect to interrupting the current and extinguishing the arc which develops upon interruption of the current. However, it has been found that there is still a need for further improvement in reliability of the current interrupting and arc extinguishing abilities of such combination current-limiting and loadbreaking devices. Further, it would be desirable to provide these improved performances with a simplified structure utilizing a minimum number of components.

Therefore, it is accordingly an object of this invention to provide a combination current-limiting and loadbreaking device which more reliably extinguishes the arc generated upon loadbreaking. Further, it is another object of the invention to provide the combined functions of current-limiting and loadbreaking with a minimum number of components in a device which is readily assembled but which still provides the desired improvement in operating performance.

SUMMARY OF THE INVENTION

The foregoing objects are accomplished in accordance with this invention, in one form thereof, by providing a combined current-limiting and loadbreaking device housed within a canister formed of an insulating tube. A flange or mounting means is provided at one end of the tube for mounting the canister on a wall of the housing enclosing the electrical apparatus to be protected by the device. The canister, which extends into the housing, is closed at the inner end by an assembly which forms a loadbreak contact member of the combination fuse and loadbreak device. This loadbreak contact member extends into the insulating tube and is surrounded by a sleeve formed of an insulating arc extinguishing material. An insulating spacer and a non-loadbreak contact assembly are secured to one end of a current-limiting fuse, while a loadbreak contact probe having an insulating tip is secured to the opposite end of the fuse. The end of the insulating spacer remote from the fuse is provided with a cap which covers the external end of the canister and with a means for removing the fuse and loadbreak contact member from the canister. A non-loadbreak contact ring is provided inside the canister for engaging the non-loadbreak contact assembly connected to the fuse. An electrical connection portion extends through the canister for making electrical connection to the non-loadbreak contacts external to the canister within the housing. A barrier of an insulating and arc extinguishing material closely spaced from the inner wall of the canister is supported between the loadbreak contact probe and fuse. This barrier, along with an enlarged portion of the sleeve closely spaced from the inner wall of the canister, confine the hot gases resulting from the arcing which may occur between the loadbreak contacts and serve to cool and defuse the ionized gases generated by the arc.

BRIEF DESCRIPTION OF THE DRAWINGS

The subject matter which we regard as our invention is particularly pointed out and distinctly claimed in the concluding portion of the specification. The invention itself, however, together with further objects and advantages thereof, may be best understood by reference to the following description taken in conjunction with the accompanying drawings, in which:

DESCRIPTION OF THE PREFERRED EMBODIMENT

Figure 1:
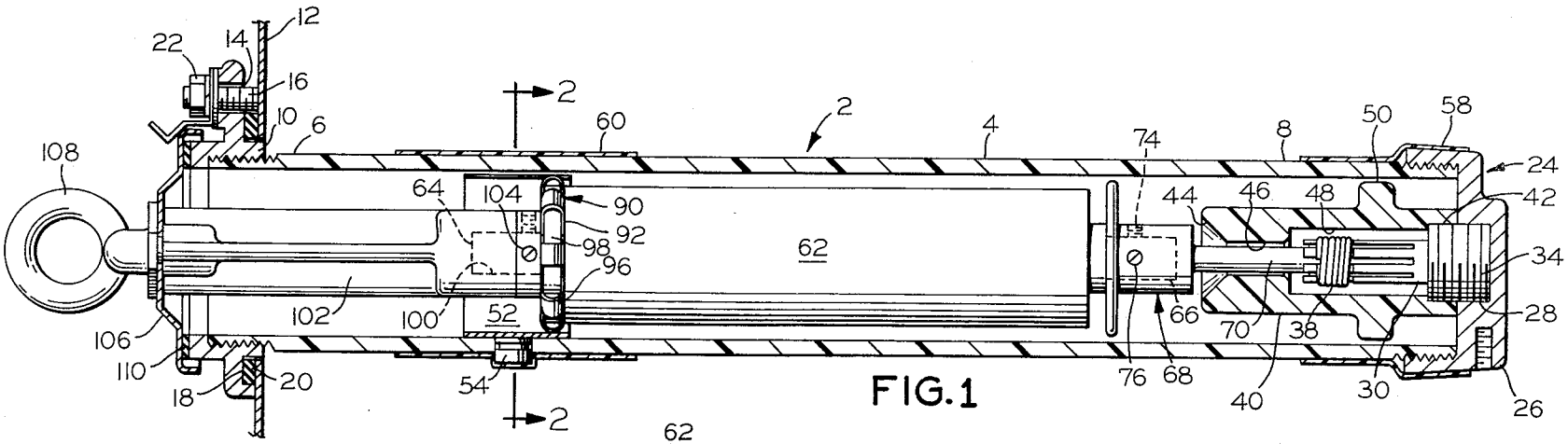
FIG. 1 is an elevation view, partially in cross-section, showing an electrical loadbreak fuse and canister assembly constructed in accordance with the preferred embodiment of this invention.
Figure 3:
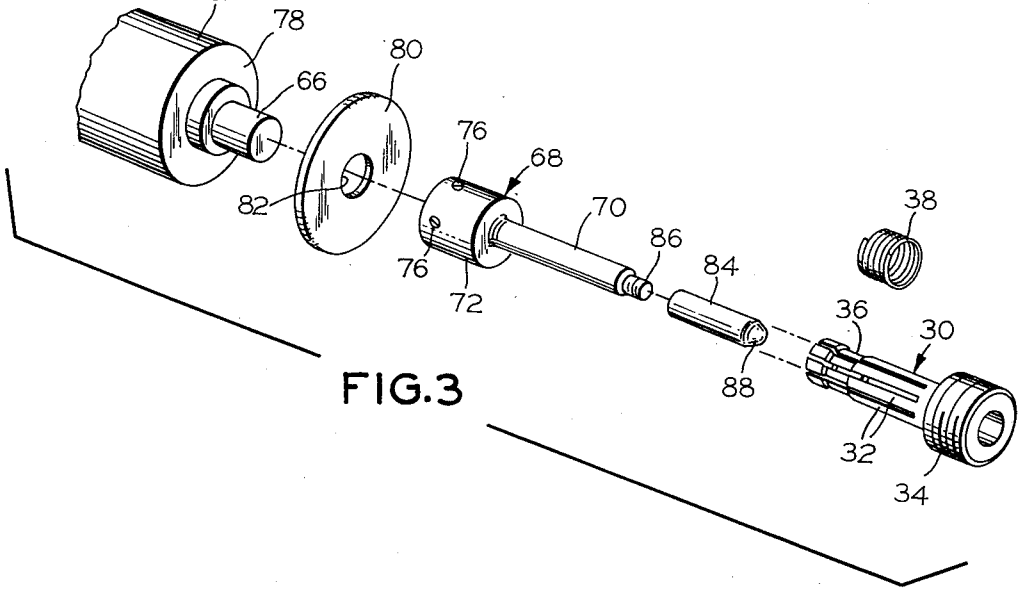
FIG. 3 is an exploded perspective view of the loadbreak contacts shown in FIG. 1.
Figure 2:
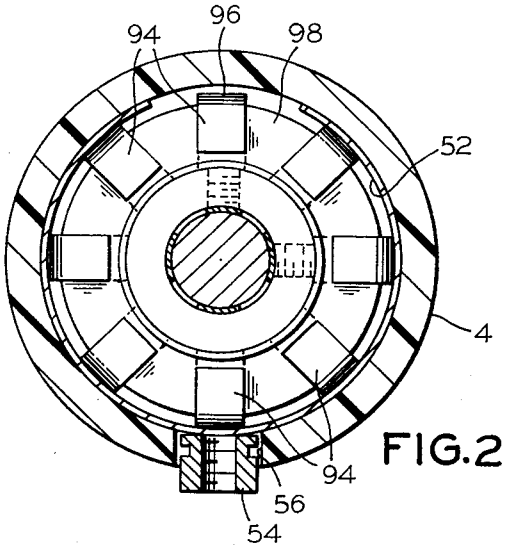
FIG. 2 is a cross-sectional view of the nonloadbreak contacts taken along the line 2—2 of FIG. 1.

Referring to the drawings, and more particularly to FIGS. 1, 2 and 3, a loadbreak fuse and canister assembly 2, constructed in accordance with the preferred embodiment of this invention is shown. The canister is in part formed of a cylindrical insulating tube 4 which is in the preferred embodiment a filament-wound oil-proof, glass-filled epoxy tube, the outer periphery of which has a resin rich surface. A first or outer end 6 and a second or inner end 8 of the tube 4 are each provided with external threads. The tube 4 is supported by a mounting means, such as a flange 10 on a wall 12 of a sealed enclosure housing an electrical device to be electrically protected by the assembly 2. In the preferred embodiment flange 10 is formed as a cast aluminum member with internal threads for receiving the external threads on the outer end 6 of the tube. The flange 10 is provided with space apertures, only one of which 14 is shown for receiving studs 16 which are used to secure the flange to the wall 12.

In a typical installation of the assembly 2, the wall 12 would be a part of the enclosure for a distribution transformer. The enclosure of which the wall 10 is a part, would contain the transformer and would be substantially filled with oil in which the transformer core and coil are emersed. The enclosure would be sealed so as to prevent atmospheric contamination of the oil. In order to provide a sealing arrangement between the flange 10 and the wall 12, an annual groove 18 is provided in the flange and an annular resilient washer 20 is placed therein. The flange 10 is secured to the side wall 12 of the enclosure by the studs 16 (one of which is shown), and nuts 22 (one of which is shown).

Secured to the inner end of the tube 4 is a closure and loadbreak contact assembly 24. In the preferred embodiment of this invention a hub 26 is formed as a cast aluminum member which is internally threaded to receive the threaded inner end 8 of tube 4. A threaded bore 28 is provided on the inner surface of the hub 26 for threadedly receiving and supporting load break contact 30. As is best seen in the exploded prospective view of FIG. 3, the loadbreak contact 30 is a tulip type contact having a plurality of fingers 32 extending from a cylindrical externally threaded base 34. This contact may, for instance, be machined from a hard tempered copper rod. The fingers 32 are provided with a groove 36 near their free end for receiving a coil spring 38 which exerts an inward force on the fingers. Threaded base 34 of the contact 30 is received in the threaded bore 28 in the hub 26.

An insulating sleeve 40 having a stepped internal diameter is provided with internal threads 42 at one end for engagement with the threaded-base 34 of the contact 30. The free or inner end of the sleeve 40 is provided with a conical opening 44, the smaller end of which opens into a bore of reduced cross-section 46 in sleeve 40. The portion of the sleeve 40 surrounding the finger 32 of contact 30 has a bore of enlarged cross-section 48. The outer wall of the sleeve 40 is provided intermediate its length with a portion 50 of enlarged cross-section. The perimeter of this enlarged portion substantially conforms to the inner wall of the tube 4, being spaced apart only sufficiently to provide clearance for assembly.

A non-loadbreak contact ring 52 is formed of a resilient conductive material such that when placed in the tube 4 it expands to engage the inner wall of the tube. The contact ring 52 is preferably formed of a brush alloy beryillium copper, the natural diameter of which is larger than the internal diameter of the tube 4, such that spring pressure will be exerted against the tube by the contact ring. A connector stud 54 extends from the contact ring 52 through an aperture 56 provided in the wall of the tube 4. The inner surface of the tube 4 may be roughened in the area of the contact ring 52 and an adhesive provided between the inner wall of the tube and the contact ring to assure the permanent placement of the contact ring.

In order to obtain a positive seal between the threads on flange 10 and hub 26 and the threaded ends of tube 4, the threads are coated with a room temperature vulcanizing material prior to assembly. A room temperature vulcanizing material is aslo applied around the connector stud 54 to provide a seal between the stud and the tube. Finally, a semi-conductive coating is applied to the outer surface of the tube 4, adjacent the hub 26 as shown at 58 and in the area overlaying the contact ring 52 as shown at 60 to prevent or minimize corona discharges from the electrical connections in these areas.

Having thus described the canister assembly, the fuse and movable contact assembly that is received therein will now be described. A load limiting fuse 62 is provided with mounting studs 64 and 66 which also serve as electrical connections for the fusible element of the fuse. Secured to mounting stud 66 is a movable loadbreak contact 68 which mates with the loadbreak contact 30. Loadbreak contact 68 includes a cylindrical contact engaging portion 70 which is formed from a conductive material such as brass. The conductive portion of the loadbreak contact, which may be formed as a machined part, is provided with an enlarged cylindrical portion 72 which has a bore therein for receiving the contact stud 66 of the fuse 62. Threaded holes 74 are provided in the enlarged portion 72 for receiving set screws 76 which securing the stud 66 of the fuse in the bore of enlarged portion 72 of the contact 68.

The stud 66 of the fuse is provided with a shoulder 78, against which is placed a disc-shaped barrier 80 formed of an insulating arc suppression material such as acetal homopolymer, acetal copolymer or an equivalent. This barrier, the outer periphery of which is closely spaced from the inner surface of the tube 4, is provided with a bore 82 through which passes the stud 66. The barrier is held in place between the shoulder 78 and the enlarged cylindric portion 72 of the contact.

Attached to the free end of the cylindrical contact engaging portion 70 of contact 68 is an insulating contact tip 84. The contact tip 84 may be formed of the same insulating arc suppression material as barrier 80. The external diameter of the contact tip 81 is the same as that of the cylindrical contact engaging portion 70. The tip 84 is provided at one end with a threaded aperture for receiving a threaded stud 86 of the movable loadbreak contact 68, and at the free end with a conical tip 88 for engagement with the fingers 32 of the fixed loadbreak contact 30 to aid in spreading them upon insertion of the movable loadbreak contact 68.

At the outer, or left end of the fuse 62, as viewed in FIG. 1, a non-loadbreak contact 90 is secured to the fuse mounting stud 64. The non-loadbreak contact 90, which is shown in the cross-sectional view of FIG. 2 is formed of a resilient contact material and has an annular base portion 92 from which radially extend a plurality of fingers 94. The fingers 94 are bent back on themselves in a U-shape as shown at 96 in FIG. 1 around a washer 98. The outer surfaces of the bights of the U-shaped fingers engage the contact ring 52 with spring force when the fuse and movable contact assembly is positioned in its operating position in the canister. After the contact 90 is assembled over the stud 61 of the fuse, a bore 100 in an insulator 102 is positioned over the stud 64 and is secured thereto by a screw 104. The annular base portion 92 of the contact 90 is captured between the washer 98 and the end wall of the fuse, while the free ends of the fingers 94 are captured between the washer 98 and the end wall of the insulator 102.

Attached to the outer end of the insulator 102 is a cap 106, which may be formed of stainless steel, and which is secured to the insulator 102 by threaded engagement of the eyebolt 108 in a bore provided in the insulator. A felt annular gasket 110 is positioned between the flange 10 and the cap 106 to provide a seal therebetween. The fuse and movable loadbreak contact assembly is held in the operative or engaged position in the canister by clips 112 (one of which is shown) which are secured to the flange 10 by the nuts 22.

Figure 4:
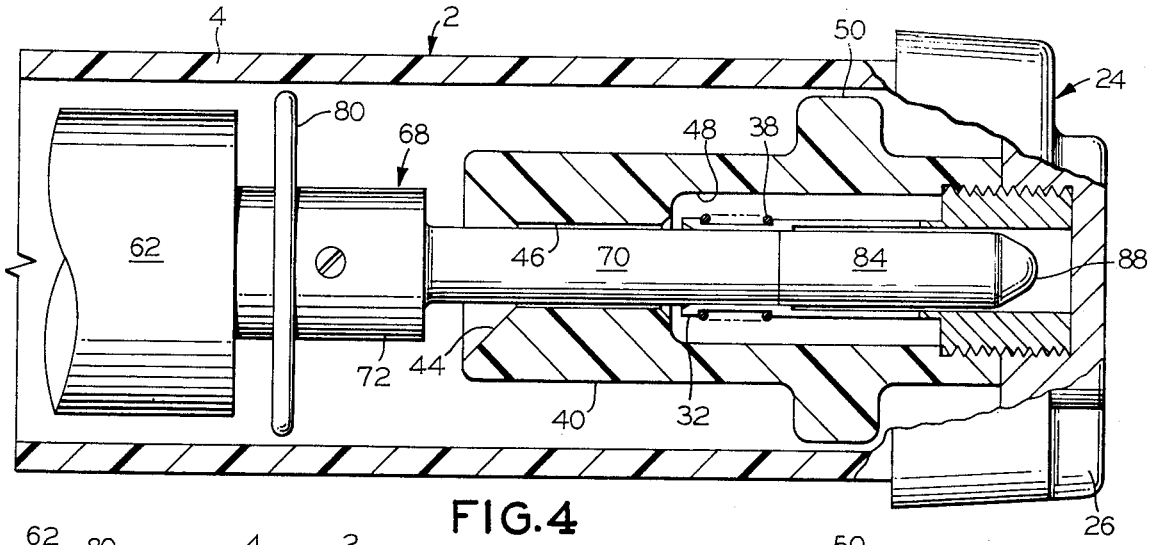
FIG. 4 is an enlarged elevation view partially in cross-section with the loadbreak contacts shown in FIG. 1 in the engaged position.

Having thus described the components and assembly of the loadbreak fuse and canister assembly, the operation will now be considered. The fuse 62, the loadbreak contacts 30 and 68, and the non-loadbreak contacts 52 and 90 are connected in series with the electrical device to be protected through suitable electrical connections within the housing by making electrical connections to connector stud 54 and hub 26. With the fuse and movable contact assembly fully inserted within the canister as shown in FIGS. 1 and 4, a circuit is completed through connector stud 54, non-loadbreak contacts 52 and 90, fuse 62, loadbreak contacts 30 and 68, and hub 26. Should excessive current flow through the device being protected, either due to a fault or an overlaod, the current-limiting fuse 62 will act to interrupt the circuit.

Figure 5:
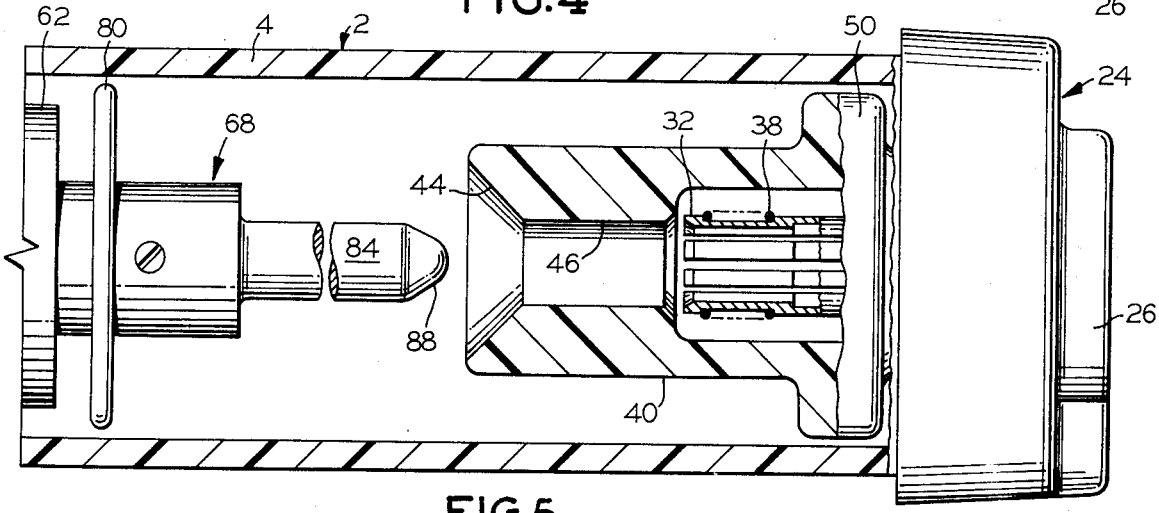
FIG. 5 is an enlarged elevation view partially in cross-section with the loadbreak contacts shown in FIG. 1 in the disengaged position.
Figure 6:
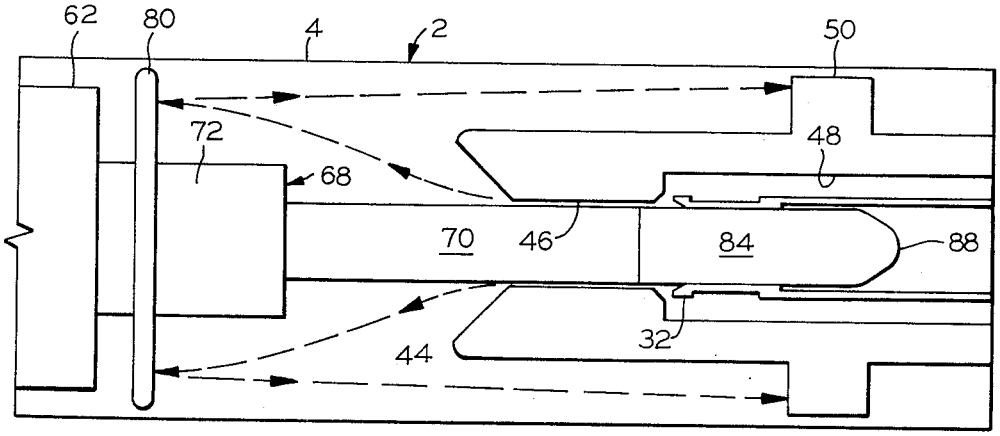
FIG. 6 is an enlarged elevation view, partially in cross-section of the loadbreak contacts shown in FIG. 1 in the position just prior to engagement or just after disengagement.

When the fuse and movable contact assembly are inserted within the canister under a fault condition, an arc of great magnitude will be established between the loadbreak contacts 30 and 68. An arc is not established between the non-loadbreak contacts 52 and 90 wherein they make contact prior to engagement of the pair of loadbreak contacts. The hot ionized gases generated by the arc are thrust out of the sleeve 40 through the bore 46 toward the fuse 62 at a high rate of velocity. The hot gases impinge upon the barrier 80 which serves as a defuser and cooling media. The hot ionized gases which rebound off of the barrier 80 arc once again defused and cooled by impingement with enlarged portion or collar 50 of the sleeve 40. This path of flow of the hot gases is shown in FIG. 6 by the dashed lines and arrows. It will be observed in FIG. 6 that the cylindrical contact engaging portion 70 and the fingers 30 are spaced apart a short distance when the arcing occurs. Thus, the collar 50 serves to prevent the hot gases from creating a flashover path around the outside of the sleeve 40 to the hub 26. Similarly, the barrier 80 serves to prevent the hot gases from creating a flashover path around the outside of the fuse 62 to the non-loadbreak contacts 52 and 90, and to the cap 106. As previously set forth the barrier 80 and the sleeve 40, including the integral collar 50, may be made of acetal homopolymer, acetal copolymer, or an equivalent material that will gas off and cool the hot ionized gases. It has been found in prior art devices without the barrier and the sleeve 40, and more particularly, the collar 50, that the hot ionized gases will travel the length of the tube and cause a flashover which may result in an explosion, fire or bodily harm to the operator. In FIG. 5 the loadbreak contacts are shown in their spaced apart position as would exist before or after engagement as shown in FIG. 4.

It should be apparent to those skilled in the art, that while what has been described is considered at the present to be the preferred embodiment of this invention, in accordance with the patent statutes, changes may be made in the disclosed electricl loadbreak, fuse and canister assembly without actually departing from the true spirit and scope of this invention.

What is claimed as new and is desired to be secured by Letters Patent of the United States is:

1. An electrical loadbreak, fuse and canister assembly comprising:

a fuse and contact assembly including, 1. an elongated fuse having first and second ends including conductive portions between which the fuse extends, and to which the fuse element is electrically connected;
2. a first non-loadbreak contact supported on and electrically connected to said first end of said fuse;
3. an elongated insulator having first and second ends, said first end being secured to said first end of said fuse;
4. a cap and operating means secured to the second end of said insulator;
5. a first loadbreak contact electrically connected to and projecting from said second end of said fuse, and having a contact engaging conductive portion and a tip formed of insulating material;
6. a barrier of insulating material supported between said contact engaging conductive portion of said first loadbreak contact and said second end of said fuse;

B. an enclosure and mounting assembly including, 1. a tube of insulating material having first and second ends forming an enclosure;
2. a mounting means for said assembly secured to said first end of said tube;
3. a second non-loadbreak contact having a contact portion adjacent the inner wall of said tube and positioned to be engaged by said first non-loadbreak contact, and having an electrical connection portion extending through the wall of said tube for making external electrical connection thereto;
4. a closure and loadbreak contact assembly secured to said second end of said tube including:
   a. a closure means closing said second end of said tube;
   b. a second loadbreak contact supported at one end and having a free end projecting into said tube for engagement with said first loadbreak contact,
   c. electrically conductive means connected to said second loadbreak contact and extending through said closure means for making external electrical connection to said second loadbreak contact;
   d. an insulating sleeve supported at one end on said closure means and having a free end projecting into said tube, said sleeve surrounding and spaced from said first loadbreak contact assembly, and spaced from the inner wall of said tube, the free end of said sleeve extending beyond the free end of said second loadbreak contact having a bore of reduced cross-sectional area, the outer wall of said sleeve intermediate its length being provided with a portion of enlarged cross-sectional area so as to be closely spaced from the inner wall of said tube:

whereby gases generated by an arc established between said first and second loadbreak contacts are first confined within said sleeve and then pass out of said bore of reduced cross-sectional area and are thereafter substantially confined to the volume defined by said barrier, the perimeter of which is closely spaced from the inner wall of said tube, said sleeve portion of enlarged cross-sectional area and the inner wall of said tube therebetween, the gases being cooled by impingement with said confining members such that as said fuse and contact assembly is removed from said enclosure, said hot gases do not escape from said enclosure around said fuse, nor do they contact said fuse, whereby said arc is extinguished without the escape of gases from said confined volume during a loadbreak operation.

2. The electrical loadbreak, fuse and canister assembly of claim 1 wherein said tube is a one-piece glass filled polyester tube.

3. The electrical loadbreak, fuse and canister assembly of claim 1, wherein said first and second ends of said tube, said mounting means, and said closure means are provided with threads whereby said mounting means and said closure means are threaded onto said tube with a sealing material being applied to the threads to effect a seal therebetween.

4. The electrical loadbreak, fuse and canister assembly of claim 1, wherein said second non-loadbreak contact is formed of a resilient ring of conducting material which engages the inner wall of said tube with spring force, and a connector stud extends from said ring and passes through an aperture provided in said tube.

5. The electrical loadbreak, fuse and canister assembly of claim 4, wherein said first non-loadbreak contact has a plurality of spring loaded contact fingers which engage said second non-loadbreak contact with spring force.

6. The electrical loadbreak, fuse and canister assembly of claim 1 wherein said first loadbreak contact is a rigid contact probe, and said second loadbreak contact is formed with a plurality of spring loaded fingers which surround and engage said contact probe when said loadbreak contacts are in the engaged position.

7. The electrical loadbreak, fuse and canister assembly of claim 1 wherein said insulating sleeve and said barrier are formed of a material which in the presence of hot ionized gases of an arc will evolve gas to cool off the hot ionized gases and thereby extinguish the arc.

8. The electrical loadbreak, fuse and canister assembly of claim 3, wherein an aperture is provided in a wall of a sealed enclosure for an electrical device which is to be protected by the electrical loadbreak, fuse and canister assembly, said mounting means being secured in a sealing engagement with the wall of said sealed enclosure with said tube extending into said sealed enclosure through said aperture such that electrical connection may be made within the sealed enclosure to said electrical connection portion of said second non-loadbreak contact and to said electrically conductive means connected to said second loadbreak contact, said enclosure and mounting assembly forming part of the sealed enclosure, the interior of said tube being open to the exterior of said sealed enclosure for receiving said fuse and contact assembly while maintaining said enclosure sealed.

9. The electrical loadbreak, fuse and canister assembly of claim 1 wherein a gasket is positioned between said mounting means and said cap to provide a seal therebetween.

10. The electrical loadbreak, fuse and canister assembly of claim 1, wherein said first non-loadbreak contact and said elongated insulator and said first loadbreak contact and said barrier of insulating material are removable secured to said first and second ends of said elongated fuse, whereby a blown fuse may be readily replaced in said fuse and contact assembly.

11. The electrical loadbreak, fuse and canister assembly of claim 1 wherein a semi-conductive coating is applied to the outer surface of said tube of insulating material so as to overlay the contact portion of said second non-loadbreak contact and is applied to the outer surface of a portion of said closure means and the adjacent outer surface of said tube of insulating material, so as to prevent or minimize corona discharge from the electrical connections in these areas.

12. The electrical loadbreak, fuse and canister assembly of claim 1, wherein room temperature vulcanizing material is applied around said electrical connection portion of said second non-loadbreak contact extending through the wall of said tube and between said closure means and said second end of said tube so as to provide seals between said contact portion of said second non-loadbreak contact, said closure means, and said tube of insulating material.

* * * * *